US008707973B2

(12) United States Patent
Yoon et al.

(10) Patent No.: US 8,707,973 B2
(45) **Date of Patent: *Apr. 29, 2014**

(54) DISHWASHER

(75) Inventors: Sangheon Yoon, Seoul (KR); Taehee Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 853 days.

This patent is subject to a terminal disclaimer.

(21) Appl. No.: 12/827,201

(22) Filed: Jun. 30, 2010

(65) Prior Publication Data

US 2011/0126865 A1 Jun. 2, 2011

(30) Foreign Application Priority Data

Dec. 2, 2009 (KR) ..... 10-2009-0118333

(51) Int. Cl.
*B08B 3/00* (2006.01)
*B08B 3/04* (2006.01)

(52) U.S. Cl.
USPC ..... 134/104.1; 134/56 D; 134/57 D; 134/58 D

(58) Field of Classification Search
USPC ..... 134/104.1
See application file for complete search history.

(56) References Cited

U.S. PATENT DOCUMENTS

| | | | | |
|---|---|---|---|---|
| 4,217,220 | A * | 8/1980 | Egli et al. | 210/791 |
| 4,754,770 | A | 7/1988 | Fornasari | |
| 5,328,617 | A * | 7/1994 | De Haan et al. | 210/768 |
| 5,450,868 | A | 9/1995 | Young, Jr. | |
| 2006/0237049 | A1 | 10/2006 | Weaver et al. | |
| 2009/0032061 | A1 | 2/2009 | Beer et al. | |

FOREIGN PATENT DOCUMENTS

| | | | | |
|---|---|---|---|---|
| CH | 169630 | | 8/1934 | |
| DE | 4131914 | A1 | 4/1993 | |
| DE | 100 46 349 | | 3/2002 | |
| DE | 10 2004 004 104 | | 7/2004 | |
| DE | 102007060196 | A1 * | 6/2009 | A47L 15/42 |
| WO | WO 2007/017330 | | 2/2007 | |

OTHER PUBLICATIONS

German Office Action issued in German Application No. 10 2010 036 845.8 dated Jun. 20, 2011.
U.S. Office Action issued in U.S. Appl. No. 12/827,160 dated Dec. 17, 2012.
Office Action issued in U.S. Appl. No. 12/827,242 dated Jun. 18, 2013.
Office Action issued in U.S. Appl. No. 13/076,890 dated Jul. 23, 2013.
Dictionay.com, "Gear (Dictionary.com).pdf", http://dictionary.reference.com/browse/gear, p. 2.
U.S. Final Office Action issued in U.S. Appl. No. 13/076,890 dated Jan. 29, 2014.

* cited by examiner

*Primary Examiner* — Joseph L Perrin
*Assistant Examiner* — Levon J Shahinian
(74) *Attorney, Agent, or Firm* — KED & Associates, LLP

(57) ABSTRACT

A dishwasher is provided that prevents foreign materials from remaining lodged in a filter. The dishwasher may include a sump in which washing fluid is collected, a filter provided in the sump so as to separate foreign materials from the washing fluid, and a cleaning device including at least one blade that scrapes foreign materials from the filter as the cleaning device moves, either in a rotating direction or a linear direction.

21 Claims, 15 Drawing Sheets

DISHWASHER

CROSS-REFERENCE TO RELATED APPLICATION(S)

This claims priority under 35 U.S.C. §119 and 35 U.S.C. 365 to Korean Patent Application No. 10-2009-0118333, filed in Korea on Dec. 2, 2009, which is hereby incorporated by reference in its entirety.

BACKGROUND

1. Field

A dishwasher is provided, and more specifically, a dishwasher that prevents foreign materials from remaining lodged in a filter is provided.

2. Background

Generally, a dishwasher washes dishes by directing washing fluid onto wash items positioned therein. In detail, clean washing water received in a sump is directed onto dishes in the washer by a washing water injector, and is then returned to the sump and re-supplied to the washing water injecter via a filter apparatus in the sump. At the end of the wash cycle, the used washing water, together with foreign materials held in the filter apparatus, are discharged to the outside of the dishwasher.

Foreign materials accumulated in the filter apparatus during operation may generate flow resistance, thus reducing the flow rate of the washing water passing through the filter apparatus. This reduced flow rate may impact the washing performance of the dishwasher and overload a washing water pump that pumps the washing water. In addition, the foreign materials adhered to the filter are not easily removed, causing a bad odor in the inside of the washer due to decay of the foreign materials.

BRIEF DESCRIPTION OF THE DRAWINGS

The embodiments will be described in detail with reference to the following drawings in which like reference numerals refer to like elements wherein.

DETAILED DESCRIPTION

Figure 1:
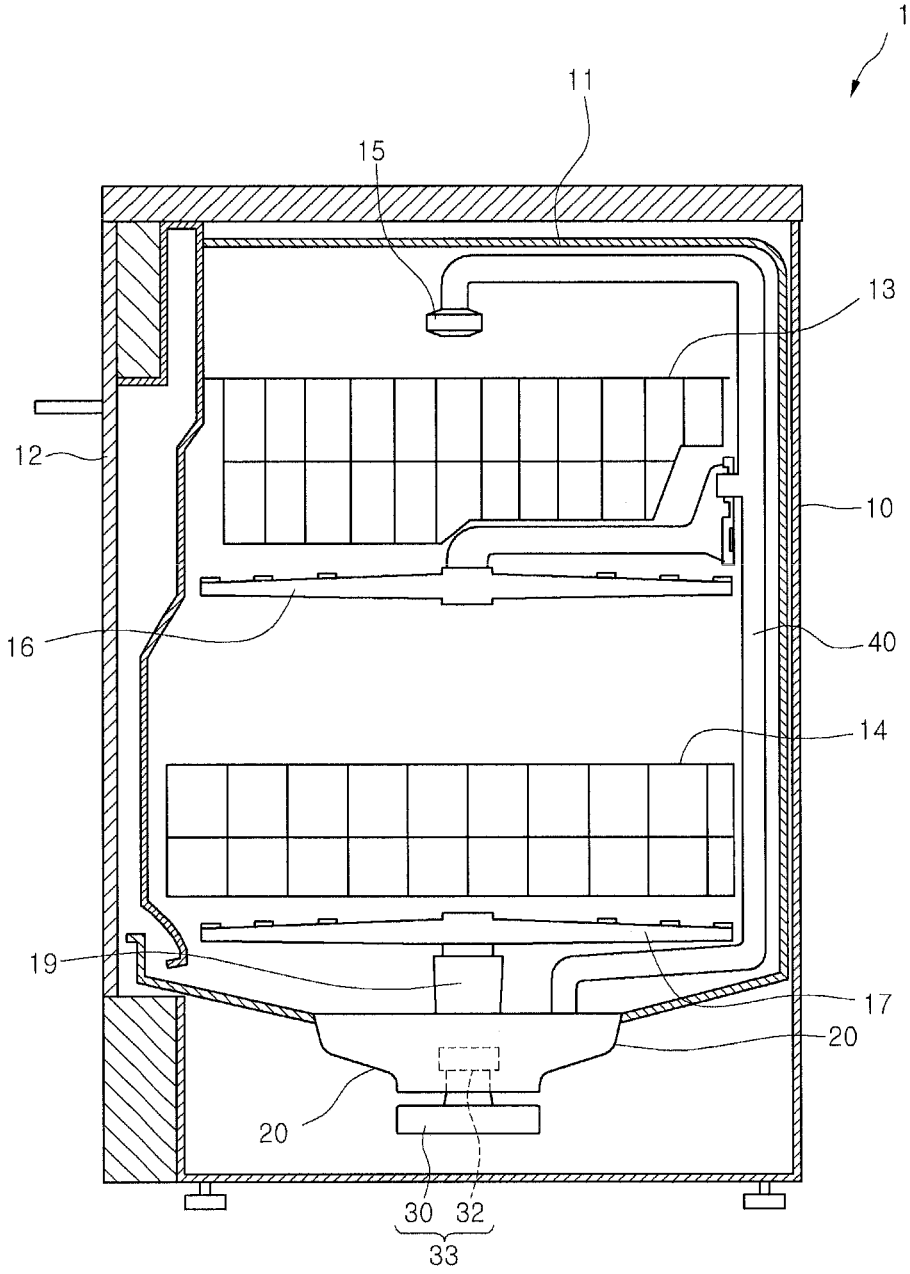
FIG. 1 is a cross-sectional view of a dishwasher according to an embodiment as broadly described herein.

Referring to FIG. 1, a dishwasher 1 as embodied and broadly described herein may include a case 10, a tub 11 that is received inside the case 10, a door 12 that is provided on a front surface of the tub 11, and a sump 20 that is provided on a lower side of the tub 11 to receive and store washing fluid. An upper rack 13 may be positioned at an upper portion of the tub 11, spaced apart from a lower rack 14 at a lower portion of the tub 11. The upper rack 13 and the lower rack 14 may be guided by guide rails provided on an inner side of the tub 11 so as to be drawn out through the front of the tub 11.

A washing motor 30 may provide a driving force to an impeller 32 coupled thereto so as to provide a pumping force that supplies washing fluid from the sump 20 to the tub 11. For ease of discussion, the washing motor 30 and impeller 32 may hereinafter be collectively referred to as a washing pump 33.

A lower nozzle 17, an upper nozzle 16, and a top nozzle 15 may receive washing fluid from the sump 20 and disperse the washing fluid in the tub 11. The lower nozzle 17 may spray washing fluid onto wash items mounted on the lower rack 14. A lower nozzle connector 19 may connect the lower nozzle 17 to the sump 20. The upper nozzle 16 may be positioned at a central portion of the tub 11 to spray washing fluid toward the upper rack 13, and the top nozzle 15 may be positioned at a ceiling portion of the tub 11 to spray washing fluid downward. A washing fluid guide 40 may guide washing fluid from the washing pump to the top nozzle 15 and the upper nozzle 16.

Figure 2:
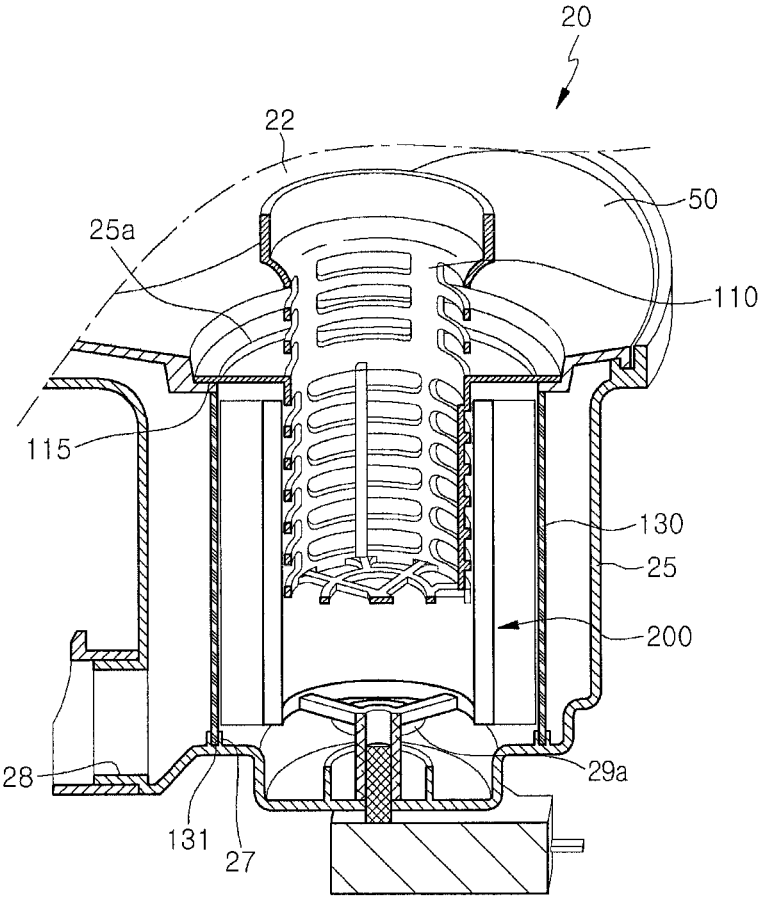
FIG. 2 is a cross-sectional view of a sump of the dishwasher shown in FIG. 1.
Figure 3:
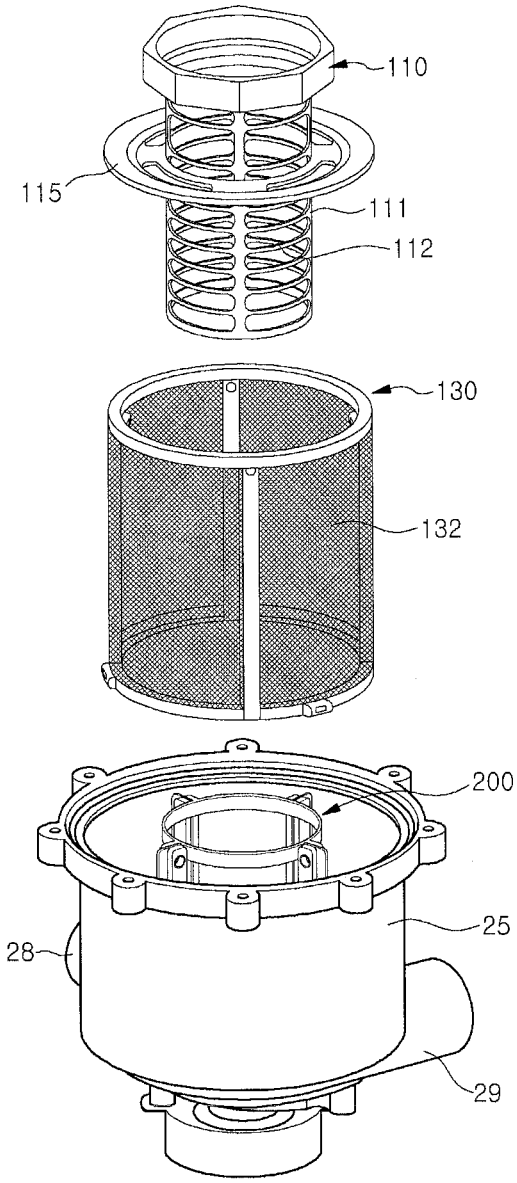
FIG. 3 is an exploded perspective view of a filter device and a rotating device of the dishwasher shown in FIG. 1.

Referring to FIGS. 2 and 3, the sump 20 may include a sump cover 22 that defines an upper surface of the sump 20, a filter housing 25 positioned below the sump cover 22 that receives first and second filters 110 and 130, and a preliminary filter 50 that is provided on the sump cover 22 to perform an initial filtering of the washing fluid before it is supplied to the first and second filters 110 and 130.

The filter housing 25 may have a concave shape that extends downward to define a filter chamber in which the first and second filters 110 and 130 are received. A washing fluid inlet 25*a* that supplies washing fluid to the filters 110 and 130 may be formed at an upper end of the filter housing 25. A pump inlet 28 that directs washing fluid between the filters 110 and 130 and the washing pump 33 may extend outward from a lower end of the filter housing 25.

Figure 9:
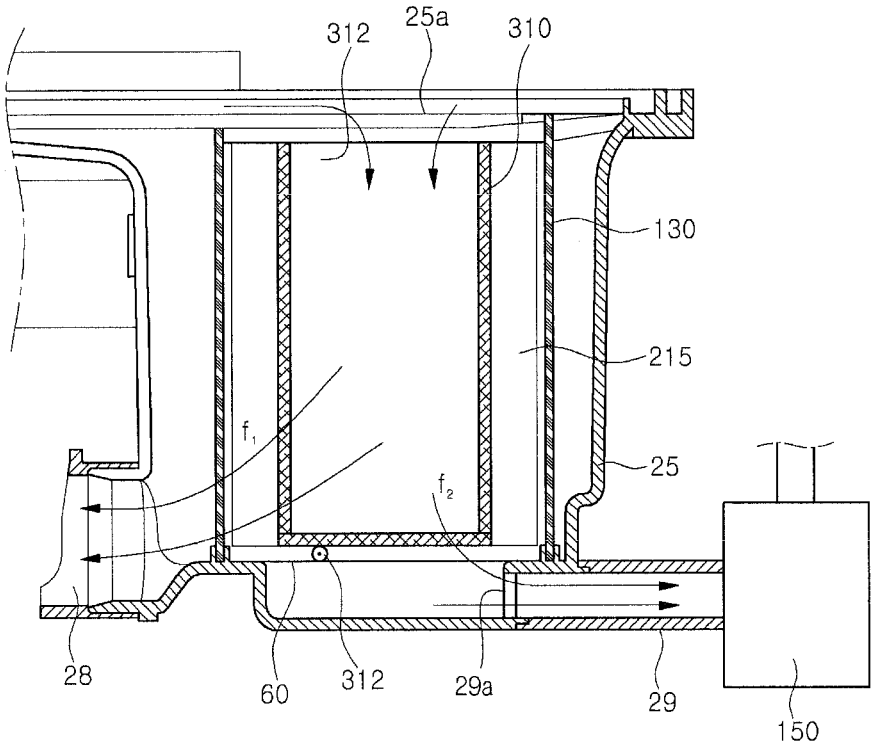
FIGS. 9 and 10 are cross-sectional views of a sump of a dishwasher according to another embodiment as broadly described herein.

A draining device 29 that discharges foreign materials and washing fluid during a draining cycle may extend outward from the lower end of the filter housing 25, in a different direction from the pump inlet 28, and may be connected to a draining pump 150 (see FIG. 9). The filter housing 25 may also include an outlet 29*a* that directs the washing fluid toward the draining device 29. The washing fluid in the filter housing 25 may be discharged through the outlet 29*a* and directed to the draining pump 150 via the draining device 29.

The first filter 110 may filter foreign materials having a relatively large volume/size from the washing fluid, and the second filter 130 may be provided at an outer side of the first filter 110 to further filter the washing fluid that has already passed through the first filter 110. The first and second filters 110 and 130 may have a substantially cylindrical shape.

The first filter 110 may include a filter main body 111 and a filter supporter 115 that extends along the filter main body 111 and supports the first filter 110 on the sump cover 22. The filter supporter 115 may be supported on a corresponding side of the preliminary filter 50, and the first filter 110 may be received inside the second filter 130. The filter main body 111 may include first through holes 112 that filter foreign materials from the washing fluid.

The second filter 130 may include second through holes 132 that filter foreign materials from the washing fluid. The second through holes 132 may have a mesh form that is more densely formed than the first through holes 112. The second filter 130 may include a lower end portion 131 that is connected to a filter connecting part 27 formed on a lower inner portion of the filter housing 25.

Figure 4:
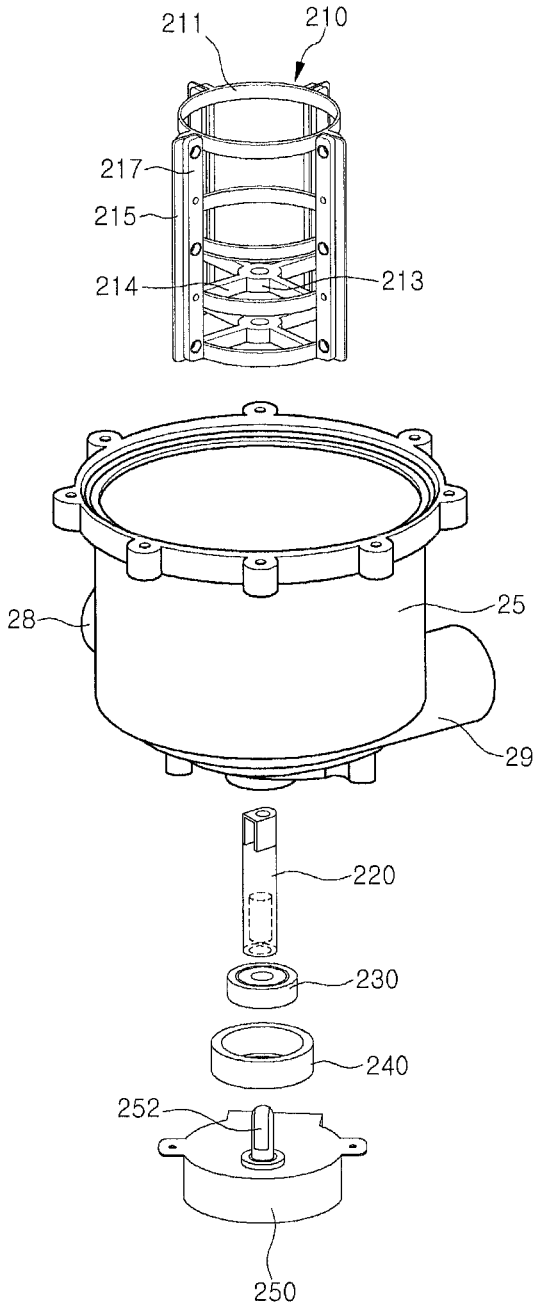
FIGS. 4 and 5 are exploded perspective views of a mounting structure of the rotating device shown in FIG. 3.
Figure 5:
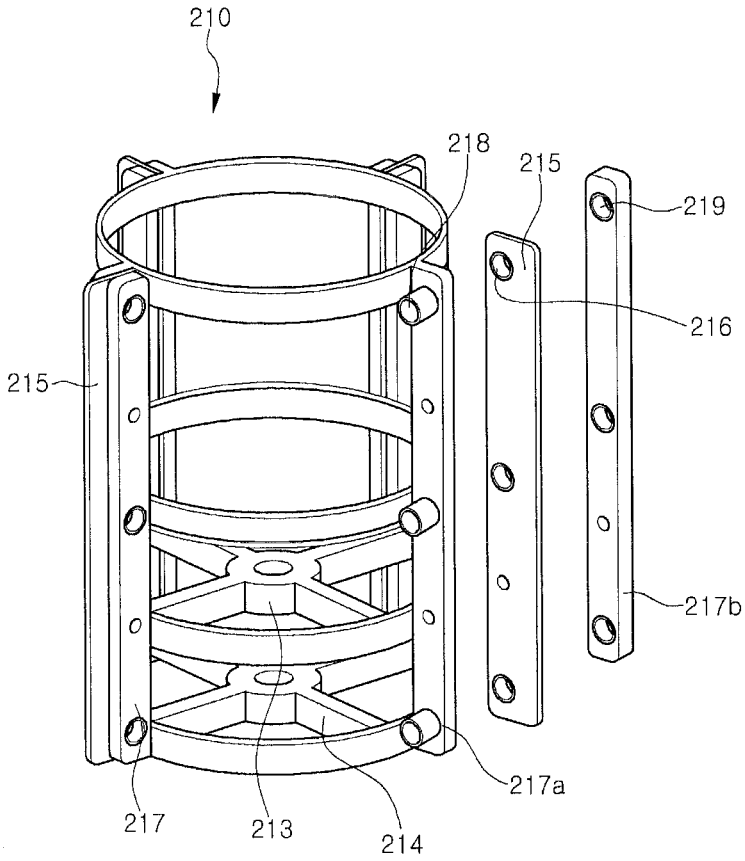

A rotating cleaner 200 may be provided in the filter housing 25 to remove foreign materials accumulated in the second filter 130. The rotating cleaner 200 will be described in detail with reference to FIGS. 4 and 5. The rotating cleaner 200 may include a rotating device 210 and a rotating motor 250 that provides a driving force to the rotating device 210.

The rotating device 210 may be received in a space formed between the first filter 110 and the second filter 130, at an outer side of the first filter 110, with at least a part of the rotating device 210 contacting an inner side of the second filter 130.

The rotating device 210 may include a frame 211, one or more blades 215 provided on an outer circumferential surface of the frame 211 so as to contact the inner side of the second filter 130, and one or more blade couplers 217 that fix the one or more blades 215 to the frame 211.

The frame 211 may have a column shape formed by a plurality of vertically spaced rings. The blades 215 may be oriented in a longitudinal direction of the frame 211 and the blades 215 may be connected to the outer side of the frame 211, at approximately the same interval, or at different intervals as appropriate.

The blade coupler 217 may include a first coupler 217*a* that supports one side of the blade 215 and a second coupler 217*b* that supports the other side of the blade 215 such that the blade 215 is positioned between the first and second couplers 217*a* and 217*b*.

Each first coupler 217*a* may include one or more corresponding connecting ribs 218 and each second coupler 217*b* may include one or more connecting holes 219 to which the connecting ribs 218 are connected. A plurality of connecting ribs 218 and connecting holes 219 may be provided along the longitudinal direction of each of the first and second couplers 217*a* and 217*b*. The blade 215 may include one or more through holes 216 positioned corresponding to the connecting ribs 218 and connecting holes 219. The connecting ribs 218 may penetrate through the through holes 216 and into the connecting holes 219 formed in the second coupler 217*b*.

At least a part of the blade 215 may extend outward beyond the outer side of the blade coupler 217 so that the protruded portion of the blade 215 may contact the second filter 130. The blade 215 may be made of a rubber or plastic material, or other materials that may be deformed in a predetermined direction. Therefore, when the rotating device 210 rotates and the blade 215 contacts the second filter 130, the blade 215 may deform in a predetermined direction. Alternatively, the blades 215 may be made from a hard material so as to fill the width of the space formed between the filters 110 and 130.

A rotating motor 250 may be provided at a lower portion of the filter housing 25 to generate a driving force to rotate the rotating device 210, with a rotating shaft 220 that transmits the driving force of the rotating motor 250 to the rotating device 210. The rotating motor 250 may include a motor shaft 252 connected to the rotating shaft 220. A shaft housing 240 may receive the rotating shaft 220 and a seal 230 may be provided inside the shaft housing 240 to support the rotating shaft 220. The rotating shaft 220, which is connected to the rotating motor 250, may penetrate through the lower surface of the filter housing 25 to connect to the rotating device 210. The rotating device 210 may include a shaft connector 213 to which the rotating shaft 220 is connected, one or more reinforcing ribs 214 that extend from the shaft connector 213 to the frame 211 to reinforce the strength thereof. The shaft connector 213 may have a hollow shape and the reinforcing ribs 214 may extend radially from the shaft connector 213.

Figure 6:
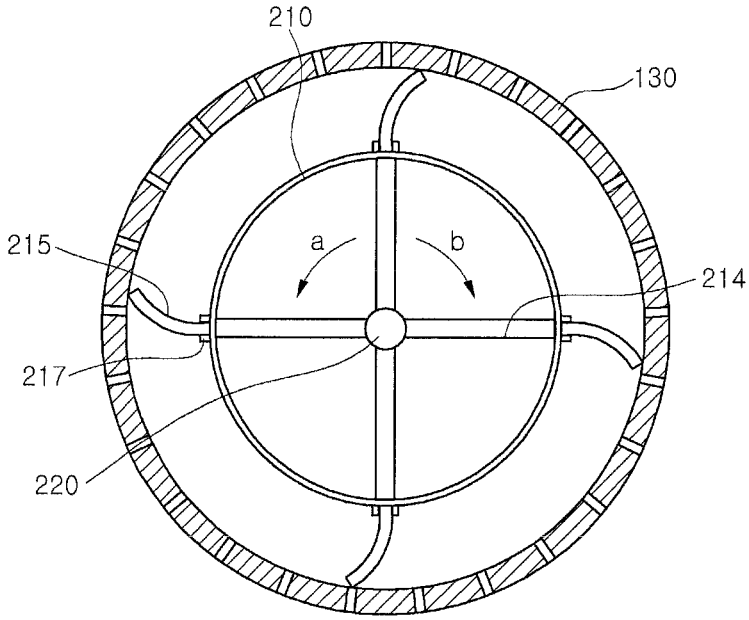
FIG. 6 illustrates operation of the rotating device shown in FIGS. 3-5.

The operation of the rotating cleaner 200 will be described with reference to FIG. 6. The rotating motor 250 may be a bi-directional motor that provides rotating force in two different directions. Therefore, when power is applied to the rotating motor 250, the rotating shaft 220 may rotate in a direction "a" or a direction "b", and, the rotating device 210 may rotate in the same direction as the rotating shaft 220. The rotating motor 250 may be rotated in the "a" or "b" direction according to a predetermined period.

When the rotating device 210 is rotated, for example, in a counterclockwise direction, the blade 215 also moves counterclockwise as it contacts the inner circumferential surface of the second filter 130. Foreign materials lodged in the second filter 130 may be dislodged from the second filter 130 as the blade 215 scrapes the second filter 130, and clogging of the second filter 130 may be prevented.

A driving cycle of the dishwasher 1 may include washing, rinsing, and drying cycles. The washing cycle may include a water supply process in which clean water is supplied from an external source, a washing process in which wash items are washed using the supplied washing water, and a draining process in which the foreign materials and the used washing water are discharged. In certain embodiments, washing water may be supplied to the sump, filtered, and supplied to the washer, and this may be repeated several times.

As the dishwasher operates, the rotating device 210 may be rotated before the draining process starts. In other words, the draining pump 150 may be driven after the rotating motor 250 is operated. When the draining pump 150 is driven and the rotating motor 250 is driven, and foreign materials are separated from the filters 110 and 130 by the rotating device 210, the foreign materials may be easily discharged through the draining device 29 together with the used washing water.

During a first washing process of the washing cycle, the rotating motor 250 may be driven. Since during the first washing process, a relatively large amount of foreign materials are lodged in the filters 110 and 130, the rotating device 210 may be rotated to dislodge the foreign materials from the filters 110 and 130. During the rinsing process, where the collection of foreign materials may be relatively small, the driving of the rotating motor 250 may be stopped.

Figure 7:
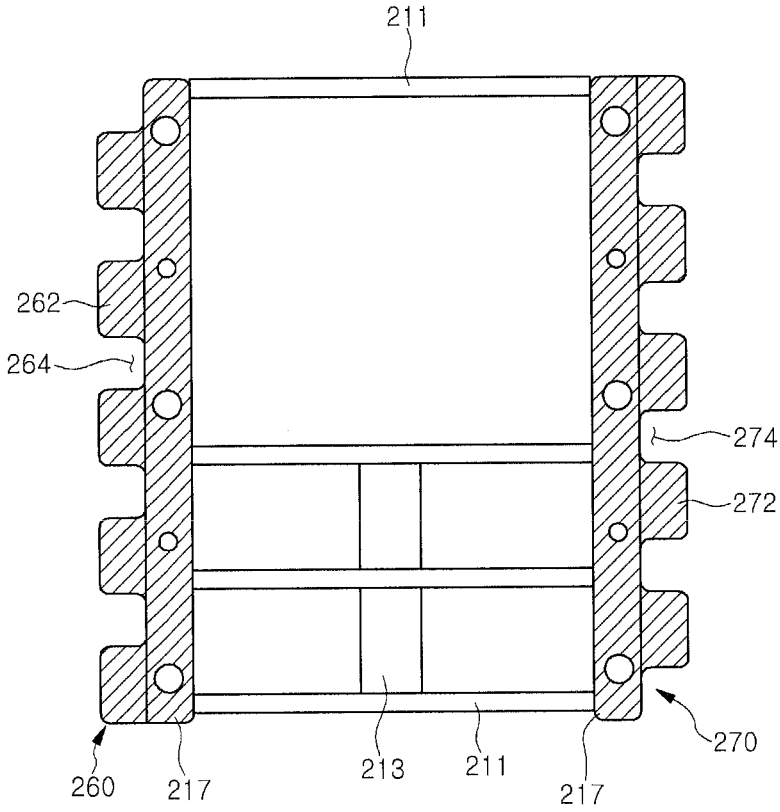
FIG. 7 is a cross-sectional view of a rotating device of a dishwasher according to another embodiment as broadly described herein.

The rotating device 210 shown in FIG. 7 includes the frame 211, and a first blade 260 and a second blade 270 that are provided on opposite sides of the frame 211 to scrape the inner surface of the second filter 130. In certain embodiments, the first blade 260 and the second blade 270 may be positioned facing/opposite each other and may have a length corresponding to a height of the frame 211. Other arrangements may also be appropriate.

The first blade 260 may include a plurality of first protrusions 262 that protrude to the outside of the blade coupler 217 and a plurality of first grooves 264 that define a space between the plurality of first protrusions 262. The first protrusions 262 and the plurality of first grooves 264 are alternately arranged from the upper portion of the first blade 260 to the lower portion thereof. Similarly, the second blade 270 may include a plurality of second protrusions 272 that protrude to the outside of the blade coupler 217 and a plurality of second grooves 274 that define a space between the plurality of second protrusions 272. In certain embodiments, the first protrusions 262 may be positioned corresponding to the second grooves 274 and the second protrusions 272 may be positioned corresponding to the first grooves 264.

As described above, when a protrusion on one side is positioned so as to correspond to a groove on the opposite side, the first protrusion 262 can scrape one portion of the inner side of the second filter 130 while the rotating device 210 is rotated, and the second protrusion 272 can scrape the remaining portion of the inner side of the second filter 130. When the blades are configured as shown in FIG. 7, the cleaning of the second filter 130 may be accomplished at a low material cost.

Figure 8:
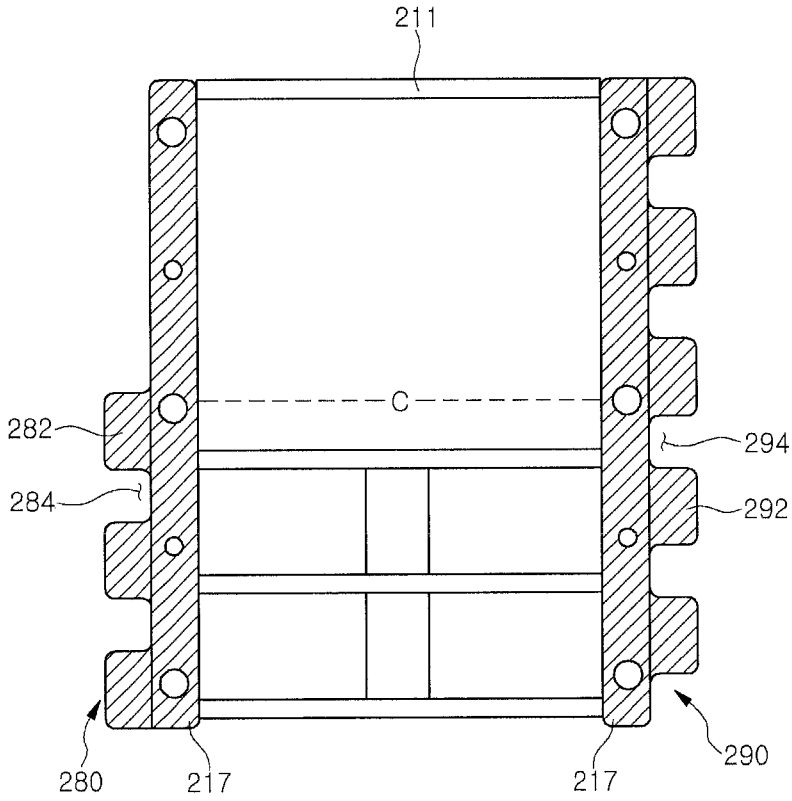
FIG. 8 is a cross-sectional view of a rotating device of a dishwasher according to another embodiment as broadly described herein.

The rotating device 210 shown in FIG. 8 includes the frame 211 and a third blade 280 and a fourth blade 290 provided on opposite sides of the frame 211 so as to scrape foreign materials from the second filter 130. In certain embodiments, the third blade 280 and the fourth blade 290 may be positioned opposite/facing each other. Other arrangements may also be appropriate.

The third blade 280 may include a plurality of third protrusions 282 that protrude to the outside of the blade coupler 217 and a plurality of third grooves 284 that define a space between the plurality of third protrusions 282. The third blade 280 may be positioned at a lower portion of one side of the frame 211. For example, the third blade 280 may extend downward from a center "C" of the frame 211. The fourth blade 290 may extend from the upper portion of the frame 211 to the lower portion thereof, and may have a length corresponding to the height of the frame 211, and may include a plurality of fourth protrusions 292 and a plurality of fourth grooves 294.

A suction force directed toward the pump inlet 28 is applied to the inside of the filter housing 25. In other words, when the washing pump 33 is driven, the washing fluid in the filter housing 25 is forcibly supplied to the pump inlet 28 by the pumping force of the washing pump 33. The pump inlet 28 is positioned at the lower portion of the filter housing 25, and thus a strong flow of washing fluid is generated at the lower portion of the filter housing 25, and foreign materials included in the washing fluid are further accumulated on the lower portions of the filters 110 and 130. In the embodiment shown in FIG. 8, the blades are concentrated on the lower portion of the frame 211, thereby making it possible to effectively remove the foreign materials accumulated in the second filter 130, and particularly in the lower portion of the second filter 130.

Figure 10:
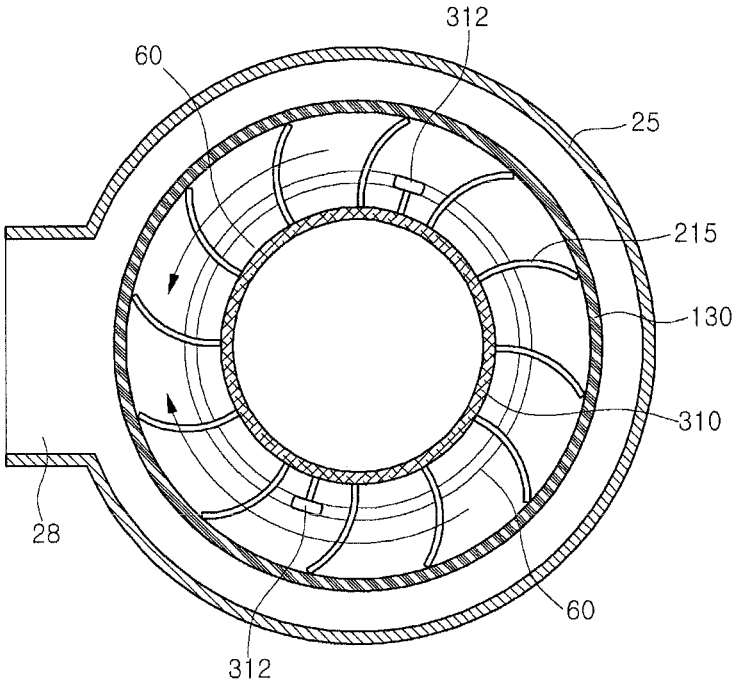
Figure 11:
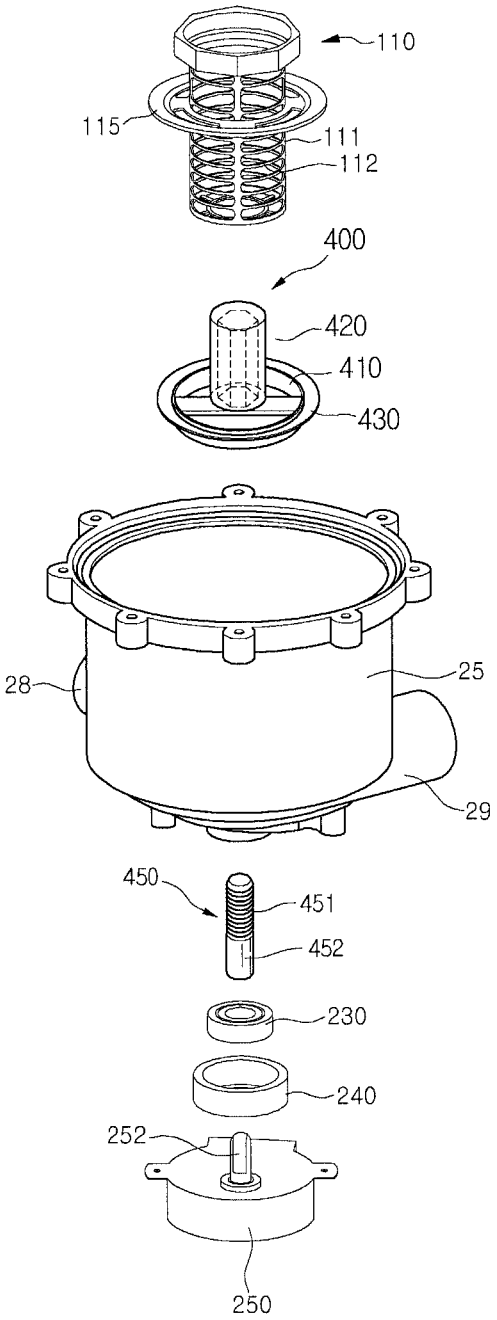
FIG. 11 is an exploded perspective view of a filter device and a movement device of a dishwasher according to another embodiment as broadly described herein.

FIGS. 9 and 10 illustrate a sump of a dishwasher according to another embodiment as broadly described herein. The sump 20 shown in FIGS. 9 and 10 includes the filter housing 25 that receives the second filter 130 and a rotating device 310 that is provided at the inner side of the second filter 130 to clean the second filter 130. Although not shown in FIGS. 9 and 10, the first filter 110 may be provided at the inner side of the rotating device 310 as described above.

The rotating device 310 may include one or more blades 215 as described above to scrape the second filter 130, and a roller 312 that easily rotates the rotating device 310. The roller 312 may be freely and rotatably connected to the lower end portion of the rotating device 310 and may be provided in plurality.

A roller guide 60 that guides the rotation of the roller 312 may be provided in the filter housing 25. The roller guide 60 may have a predetermined shape that corresponds to a rotating path of the rotating device 310. For example, the roller guide 60 may be formed as a groove that receives the roller 312, or may be provided as a separate component that supports the roller 312.

The draining device 29 is provided at the lower end portion of the filter housing 25 so that, during the draining cycle of the dishwasher, when the draining pump 150 is operated, the foreign materials and the washing fluid inside the filters 110 and 130 may be discharged to the outside through the draining unit 29.

During operation, washing fluid used for washing in the tub 11 moves to the sump 20 together with the foreign materials, and may be supplied to the filter housing 25 through the washing fluid inlet 25*a*. When the washing pump 33 is driven to apply a pumping force, a suction force is generated in the pump inlet 28, and washing fluid may flow from the washing fluid inlet 25*a* toward the pump inlet 28, that is, in a direction f1.

Since the blade 215 is positioned along the flow path of the washing fluid, the washing fluid pressurizes at least one surface of the blade 215 and thus, the blade 215 may be rotated by the pressing force f1. The direction represented by f1 may be defined as a direction that follows a shortest path from the washing fluid inlet 25*a* to the pump inlet 28. Therefore, most of the washing fluid supplied to the sump 20 will be supplied to the pump inlet 28 along the f1 direction. Consequently, the blade 215 may be rotated counterclockwise as shown in FIG. 10.

During the draining cycle of the dishwasher, when the draining pump 150 is driven, the suction force applied to the foreign materials and the washing fluid, is applied to the draining device 29, and the washing fluid may flow to the draining device 29 in a direction f2. Since the blade 215 is positioned on the draining path of the washing fluid, the washing fluid pressurizes at least one surface of the blade 215 and thus, the blade 215 be rotated by the pressing force f2. Consequently, the blade 215 may be rotated clockwise as shown in FIG. 10.

In the embodiment shown in FIGS. 9 and 10, a separate driver for rotating the rotating device is not required and the filter may be naturally cleaned by the flowing force of the washing fluid. Another embodiment including a movement device instead of a rotating device will now be described with respect to FIGS. 11-14.

Referring to FIGS. 11 to 14, the sump 20 may include the filter housing 25 that receives the first filter 110 and the second filter 130, a movement device 400 that is movably provided inside the filter housing 25 so as to move vertically, up and down, a motor 250 that is provided at a lower portion of the filter housing 25 to provide a driving force, and a rotating shaft 450 that rotates in response to the driving of the motor 250.

In detail, the movement device 400 may include a mover 410 that moves up and down along the rotating shaft 450, a moving guide 420 that guides the movement of the mover 410, and a blade 430 that is provided at the outside of the moving part 410 to clean an inner side of the second filter 130. The rotating shaft 450 includes a first screw thread 451 that is threadably connected to the mover 410 and a seal coupler 452 that is formed below the first screw thread 451 so as to be coupled to the seal 230.

The mover 410 includes a guide coupler 411 that is coupled with the moving guide 420, an extension 414 that extends outward from the guide coupler 411, a blade coupler 416 positioned at an outer periphery of the extension 414, with the blade 430 coupled with the blade coupler 416 so as to contact to the second filter 130.

A shaft coupling part 412 is formed as a recess within the guide coupler 411 to which the rotating shaft 450 is coupled. The lower part of the shaft coupling part 412 is opened to receive the rotating shaft 450 and the shaft coupling part 412 may be formed as a recess or depression that extends from the lower part to the upper part. The shaft coupling part 412 includes a second screw thread 413 corresponding the first screw thread 451 so that the mover 410 may be threadably coupled with the rotating shaft 450.

Figure 12:
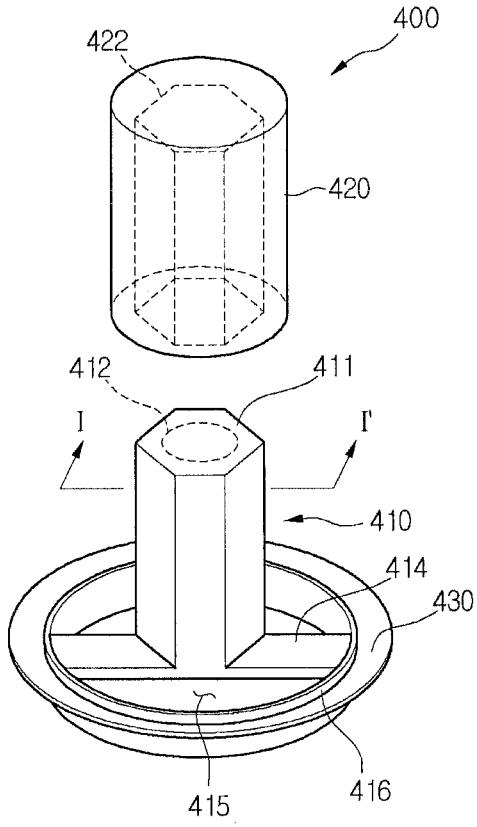
FIG. 12 is an exploded perspective view of the movement device shown in FIG. 11.
Figure 13:
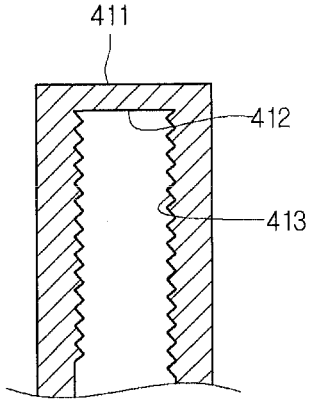
FIG. 13 is a cross-sectional view taken along line I-I of FIG. 12.

The outer circumference of the guide coupler 411 may have a polygonal shape. In FIG. 12, the outer circumference of the guide coupler 411 is hexagonal, but may be a quadrangle, an octagon, or other shape as appropriate. An inner coupling part 422 may be formed within the moving guide 420, and may have a polygonal shape corresponding to the guide coupler 411 so as to be coupled therewith. The moving guide 420 may include a fixing part 426 so that the moving guide 420 may be coupled with the first filter 110. The moving guide 420 may be fixed at a position inside the first filter 110 by the fixing part 426.

As described above, as the guide coupler 411 is surface-coupled within the moving guide 420, each having a polygonal shape, although a rotation force is applied to the guide coupler 411, the guide coupler 411 is fixed with respect to the moving guide 420 such that its rotation can be prevented.

In certain embodiments, the outer surface of the guide coupler 411 that contacts the coupling part 422 of the moving guide 420 may have a sawtooth shape so that when a friction force is applied between the outside of the guide coupler 411 and the coupling part 422, rotation of the guide coupler 411 can be prevented.

The blade coupler 416 encloses the lower outer side of the guide coupler 411 and is spaced apart from the guide coupler 411. The extension 414 extends from the outer side of the guide coupler 411 to the inner side of the blade coupler 416. The extension 414 may be provided as a plurality of extensions 414.

A flow opening 415 may be formed between the guide coupler 411 and the blade coupler 416 to allow washing fluid to flow downward therethrough. In the draining cycle of the dishwasher, washing fluid including foreign materials may flow downward through the flow opening 415 and may be discharged to the draining device 29 through the outlet 29*a*.

The blade 430 may protrude outward from the outer circumferential surface of the blade coupler 416, in certain embodiments, and may be rounded upward. While the mover 410 is moved up and down, the blade 430 scrapes the inner circumferential surface of the second filter 130 so that foreign materials attached to the second filter 130 may be removed.

The operation of the movement device 400 will be described with reference to FIGS. 14 and 15.

Figure 14:
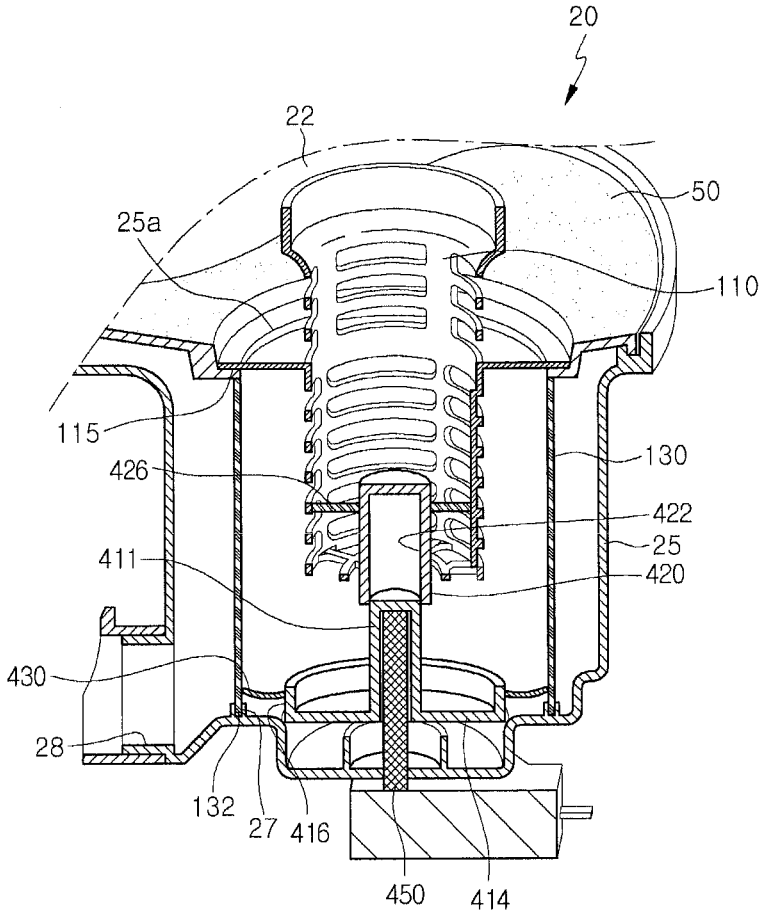
FIG. 14 is a cross-sectional view of the filter device and movement device shown in FIGS. 11 and 12, installed in a sump.

In FIG. 14, the upper part of the guide coupler 411 is coupled to the lower end portion of the moving guide 420, and the lower part of the guide coupler 411 is coupled to the first screw thread 451 of the rotating shaft 450. In this state, when the rotation motor 250 is driven to rotate the rotating shaft 450, the first screw thread 451 and the second screw thread 413 are engaged, and, the guide coupler 411 is subjected to a rotating force due to the rotation of the first screw thread 451. However, the guide coupler 411 is surface-coupled to the moving guide 420 due to its polygonal shape such that rotation is restricted. Consequently, the guide coupler 411 is not rotated, and is moved upward in response to the rotation of the first screw thread 451. When the guide coupler 411 is moved, the blade 430 is moved upward as it contacts the second filter 130, and foreign materials attached to the second filter 130 may be removed.

Figure 15:
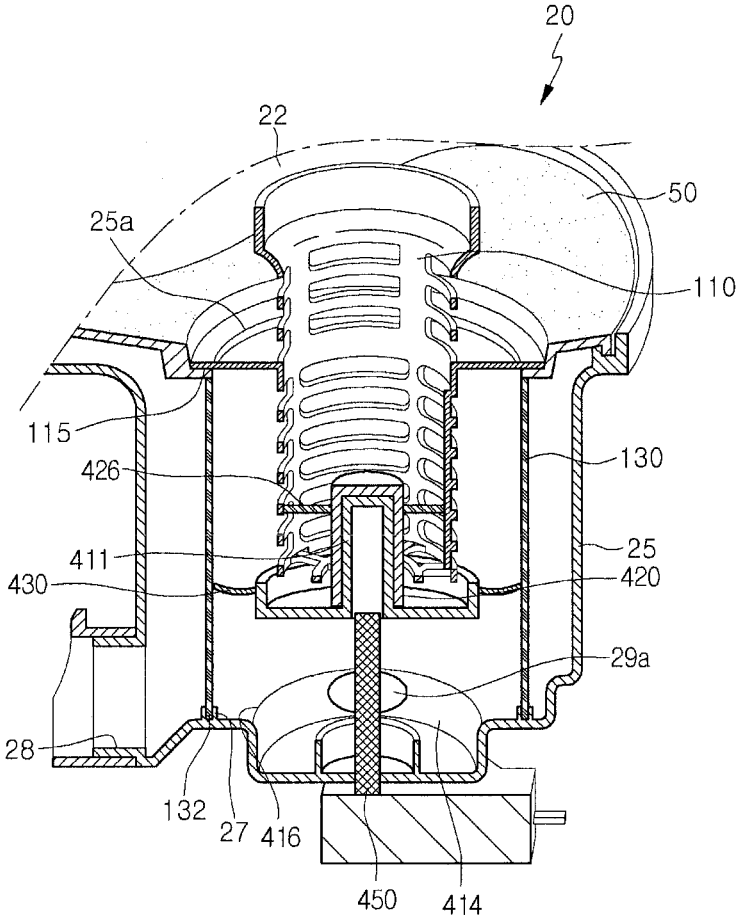
FIG. 15 illustrates operation of the movement device shown in FIGS. 11-14.

As shown in FIG. 15, if the guide coupler 411 reaches the upper part of the coupling part 422 of the moving guide 420, the operation of the rotation motor 250 may be stopped. The operation time of the rotation motor 250 may be previously set based on a movement distance of the guide coupler 411 and the rotation number of the rotating shaft 450. When so positioned, the extension 414 is located at the lower side of the moving guide 420 and the first filter 110 and the blade coupler 416 may be disposed at the outer side of the first filter 110. In the state shown in FIG. 15, when the rotation motor 250 is rotated in an opposite direction, the guide coupler 411 may be moved downward along the moving guide 420, and the blade 430 may clean the second filter 130 again.

Meanwhile, the pump inlet 28 and the outlet 29*a* are disposed at the lower part of the filter housing 25 such that a washing fluid flowing force is applied to the lower part of the filter housing 25, thereby causing foreign material to be accumulated at the lower part of the filter housing 25. In this embodiment, the blade 430 may be moved up and down in the range of an approximately intermediate height from the lower part of the second filter 130, as shown in FIGS. 14 and 15 so that the lower part of the second filter 130 is repeatedly scraped, thereby increasing cleaning efficiency.

A dishwasher is provided that prevents a filter from clogging due to foreign materials by improving a structure of a sump.

A dishwasher is provided that can remove foreign materials from a filter by cleaning at least one surface of the filter.

A dishwasher as embodied and broadly described herein may include a sump in which washing water is collected; a filter unit that is provided inside the sump to separate foreign materials in the washing water; a rotating unit that is rotatably provided to one side of the filter unit; and at least one blade that is provided to the rotating unit and scrapes the foreign materials in the filter unit.

A dishwasher according to another embodiment as broadly described herein may include a sump in which washing water is collected; a filter unit that is provided inside the sump to separate foreign materials in the washing water; a filter housing that receives the filter unit; and a rotating unit that is rotatably supported on the filter housing and cleans an inner side of the filter unit.

A dishwasher according to another embodiment as broadly described herein may include a sump in which washing water is collected; a plurality of filter units that are provided inside the sump and separate foreign materials in the washing water; a cleaning unit that is interposed between the plurality of filter units and cleans foreign materials accumulated in the filter unit, the cleaning unit being rotatably provided.

In a dishwasher as embodied and broadly described herein, the rotating unit can be provided on at least one side of the filter unit to clean the foreign materials accumulated in the filter unit, making it possible to prevent the filter unit from clogging due to the foreign materials.

In addition, foreign materials accumulated in the filter can be effectively cleaned and the flow of washing water is smooth, thereby improving washing performance.

Moreover, the foreign materials are removed from the filter surface to prevent the filter from clogging, thereby improving filtering performance.

Further, the foreign materials separated from the filter can be discharged to the outside of the dishwasher in a draining cycle, thereby preventing a bad odor due to the decay of the foreign materials.

Also, the washing performance is improved and the discharge of the foreign materials is facilitated, thereby improving the reliability of the product.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A dishwasher, comprising:

a rack positioned in a washing space and a nozzle that disperses washing fluid into the washing space;

a sump that collects washing fluid supplied to the washing space;

a plurality of filters provided in the sump, the plurality of filters comprising a first filter and a second filter, wherein the first and second filters are each substantially cylindrical, with the first filter positioned concentrically within the second filter; and a cleaning device to clean the second filter, the cleaning device comprising:

a rotatable shaft;

a frame coupled to the shaft, the frame being disposed inside the second filter so as to surround the first filter, at least one blade coupled to the frame, the at least one blade protruding from the frame towards the second filter to scrape the second filter; and a holder to hold the at least one blade, the holder being movably positioned inside the second filter, wherein a movement of the holder causes the at least one blade to scrape the second filter, which dislodges foreign materials from the second filter.

2. The dishwasher of claim 1, further comprising a driver that provides a driving force to move the shaft to rotate the frame and the at least one blade.

3. The dishwasher of claim 2, wherein the driver moves the holder and the at least one blade coupled thereto vertically.

4. The dishwasher of claim 3, wherein the holder comprises:

a rotating shaft having a first end coupled to the driver and a second end that extends through a bottom of the sump;

a mover coupled to the second end of the rotating shaft, the mover comprising:

a guide coupler in which the second end of the rotating shaft is received;

at least one extension extending radially outward from a bottom end of the guide coupler; and a blade coupler that encircles the guide coupler and the at least one extension, wherein the at least one blade comprises a ring shaped blade coupled to an outer circumference of the blade coupler; and a moving guide having a recess formed therein, wherein the guide coupler is configured to reciprocate in the recess and move the mover vertically in response to the driving force of the driver.

5. The dishwasher of claim 4, wherein the holder is positioned at an inside of the second filter such that the ring shaped blade maintains contact with an inner circumferential surface of the second filter as the driver moves the holder vertically.

6. The dishwasher of claim 1, wherein the at least one blade comprises a first blade that extends vertically along a first longitudinal outer surface of the frame and a second blade that extends vertically along a second longitudinal outer surface of the frame.

7. The dishwasher of claim 6, wherein the frame is positioned such that the first and second blades maintain contact with an inner circumferential surface of the second filter as the driver rotates the frame.

8. The dishwasher of claim 6, wherein the first blade extends from a top end of the frame to a bottom end of the frame, and the second blade extends from a center of the frame to the bottom end of the frame.

9. The dishwasher of claim 6, wherein the first and second blades are positioned opposite each other on the frame, and each extending from a top end of the frame to a bottom end of the frame.

10. The dishwasher of claim 9, wherein the first blade comprises a plurality of first protrusions respectively separated by a plurality of first recesses and the second blade comprises a plurality of second protrusions respectively separated by a plurality of second recesses.

11. The dishwasher of claim 10, wherein each first protrusion is positioned corresponding to a respective one of the plurality of second recesses, and each second protrusion is positioned corresponding to a respective one of the plurality of first recesses.

12. The dishwasher of claim 1, further comprising a filter housing in which the second filter is received, the filter housing including a pump inlet, wherein the holder and the at least one blade coupled thereto is configured to be rotated by washing fluid flowing through the filter housing toward the pump inlet.

13. The dishwasher of claim 12, wherein the pump inlet is formed at a lower outer portion of the filter housing, and wherein the at least one blade comprises a plurality of blades each having at least one scraping portion, wherein more scraping portions are positioned are coupled to a lower portion of the holder than to an upper portion of the holder.

14. The dishwasher of claim 1, wherein the at least one blade comprises:

a first blade that scrapes a corresponding first portion of an inner circumferential surface of the second filter; and a second blade that scrapes a corresponding second portion of the inner circumferential surface of the second filter.

15. A dishwasher, comprising:

a rack positioned in a washing space and at least one nozzle that disperses washing fluid into the washing space;

a sump that collects washing fluid supplied to the washing space;

a pump positioned adjacent to the sump so as to supply washing fluid to the at least one nozzle;

a plurality of filters that filter foreign materials from washing fluid before the washing fluid is supplied to the pump, the plurality of filters comprising:

a first filter that performs a primary filtering of the washing fluid; and a second filter configured to receive washing fluid from the first filter and to perform a secondary filtering of the received washing fluid, wherein the first and second filters are each substantially cylindrical, with the first filter positioned concentrically within the second filter; and a filter cleaner movably positioned adjacent to the plurality of filters so as to dislodge foreign materials from at least one of the plurality of filters, wherein the filter cleaner is positioned within a space formed between the first and second filters so as to contact an inner circumferential surface of the second filter.

16. The dishwasher of claim 15, further comprising a filter housing in which the plurality of filters are received, wherein the filter housing includes a guide groove formed therein that guides a rotation of the filter cleaner within the filter housing.

17. The dishwasher of claim 15, further comprising a driver, comprising:

a bi-directional motor; and a shaft that transfers a driving force generated by the motor to the filter cleaner so as to move the filter cleaner relative to the plurality of filters.

18. The dishwasher of claim 17, wherein the filter cleaner comprises:

a shaft connecting part that receives the rotating shaft;

at least one reinforcing rib that extends radially outward from the shaft connecting part;

a plurality of vertically spaced rings that form a frame, wherein a distal end of the at least one reinforcing rib is connected to an inner circumferential surface of a respective ring; and at least one blade coupled to an outside of the frame and extending in a longitudinal direction thereof.

19. The dishwasher of claim 18, wherein the frame rotates in response to a rotating force generated by the motor, and wherein the at least one blade maintains sliding contact with an inner circumferential surface of one of the plurality of filters so as to scrape foreign materials from the one of the plurality of filters.

20. The dishwasher of claim 17, wherein the filter cleaner comprises:

a mover coupled to a distal end of the shaft, the mover comprising:

a guide coupler in which the distal end of the shaft is received;

at least one extension extending radially outward from a bottom end of the guide coupler;

a blade coupler that encircles the guide coupler and the at least one extension; and a ring shaped blade coupled to an outer circumference of the blade coupler; and a moving guide having a recess formed therein, wherein the guide coupler is configured to reciprocate in the recess and move the filter cleaner vertically in response to the driving force generated by the motor.

21. The dishwasher of claim 20, wherein the ring shaped blade maintains sliding contact with an inner circumferential surface of the second filter so as to scrape foreign materials from the second filter as the filter cleaner moves up and down in response to the driving force generated by the motor.

* * * * *